US005256619A

United States Patent [19]

Yoshida et al.

[11] Patent Number: 5,256,619

[45] Date of Patent: Oct. 26, 1993

[54] HEAT-SENSITIVE RECORDING MATERIAL

[75] Inventors: Masatoshi Yoshida, Osaka; Katsuyuki Kono, Kyoto; Kiyoshi Kawamura, Mishima, all of Japan

[73] Assignee: Nippon Shokubai Co., Ltd., Osaka, Japan

[21] Appl. No.: 725,527

[22] Filed: Jul. 3, 1991

[30] Foreign Application Priority Data

Jul. 5, 1990 [JP] Japan ..... 2-176339

[51] Int. Cl.[5] ..... B41M 5/40

[52] U.S. Cl. ..... 503/226; 427/152; 503/200

[58] Field of Search ..... 503/200, 226; 427/152

[56] References Cited

U.S. PATENT DOCUMENTS

| | | | |
|---|---|---|---|
| 5,094,998 | 3/1992 | Hoshino et al. | 503/200 |
| 5,106,813 | 4/1992 | Hoshino et al. | 503/200 |

FOREIGN PATENT DOCUMENTS

| | | | |
|---|---|---|---|
| 0326964 | 1/1989 | European Pat. Off. . | |
| 0344705 | 5/1989 | European Pat. Off. . | |
| 3942692 | 7/1990 | Fed. Rep. of Germany . | |
| 120492 | 7/1982 | Japan | 503/226 |
| 57-135195 | 8/1982 | Japan . | |
| 025988 | 2/1983 | Japan | 503/226 |
| 60-18385 | 1/1985 | Japan . | |
| 62-244693 | 10/1987 | Japan . | |
| 2162090 | 6/1990 | Japan . | |
| 2169292 | 6/1990 | Japan . | |

OTHER PUBLICATIONS

Translation of Japan Koho No. 58-25988, all pages.

Patent Abstracts of Japan vol. 8, N. 274 (M-345) (17/11) Dec. 14, 1984, & JP-A-59 143683 (NIppon Kayaku K.K.) Aug. 17, 1984, no translation.

Patent Abstracts of Japan vol. 9, No. 34 (M-357) (1757) Feb. 14, 1985, & JP-A-59 176091 (Ricoh K.K.) Oct. 5, 1984 no translation.

*Primary Examiner*—Pamela R. Schwartz

*Attorney, Agent, or Firm*—Oblon, Spivak, McClelland, Maier & Neustadt

[57] ABSTRACT

A heat-sensitive recording material excelled in surface gloss and printing concentration is disclosed.

The disclosed heat-sensitive recording material with a heat-sensitive color-developing layer formed on a supporting member features provision on the surface of the heat-sensitive color-developing layer of a protective coating containing crosslinked microfine particles (B) having substantially no glass transition temperature, 0.5 μm or less in mean particle size and 0.05 or less in the difference in refractive index from the solid content of aqueous resin despersion which are obtainable by emulsion-polymerizing vinyl-containing monomers containing 15 weight % or more of polymeric multifunctional monomers together with the aqueous resin dispersion (A).

5 Claims, No Drawings

HEAT-SENSITIVE RECORDING MATERIAL

BACKGROUND OF THE INVENTION

1. Field of the Invention

The present invention relates to a heat-sensitive recording material and especially a heat-sensitive recording material excelled in surface gloss, printing concentration, sticking resistance, resistance to water and solvent et cetera.

2. Description of the Prior Art

A heat-sensitive recording material having a dyestuff type heat-sensitive color-developing layer represented by combination of a leuco dye and a phenolic acidic substance is now being widely used in the field of thermal printers, facsimiles, measuring instruments recorders and, with its developing property, paper whiteness, applicability to various recording devices and economic feature highly appreciated, new uses are still being developed even now and, as a result, the requirement for improvement in quality of heat-sensitive recording material is being variegated and being further raised.

Conventional heat-sensitive recording materials made by applying heat-sensitive color-developing coating to a supporting member have defects of printed image area being erased or non-image area being developed when they are exposed to some of the known solvents, water, light, plasticizers et cetera. The same tendency is noted when they are stored for a long time, hence desired is improvement of storage stability of heat-sensitive recording material.

As a method of eliminating the aforementioned defects there has been developed a method of providing a protective coating on the heat-sensitive color-developing layer. As a binder for forming this protective coating has hitherto been known water-soluble high polymers such as polyvinyl alcohol, hydroxyethylcellulose, methylcellulose, carboxymethylcellulose, starches, caseins, polyacrylamide-type polymers, styrene-anhydrous maleic acid copolymer and polyacrylate and aqueous emulsions such as SBS latex (SBS is styrene-butadiene-styrene) but since protective coatings using some of the aforementioned coating compositions are not so good in sticking resistance, noise is apt to be caused during image formation, and in some cases the coating adheres to the thermal head, this often resulting in failure to obtain a proper image.

For eliminating the aforementioned defects and improving the sticking resistance there have been proposed methods of using in combination inorganic pigments, cellulose powder, microfine glass particles, colloidal silica, thermosetting resin, silicone type compounds et cetera (for example, Patent Publication No. 58-35874, Patent Publication No. 63-63397, Laid-open Patent Publication No.57-120489, Laid-open Patent Publication No. 60-18385, Laid-open Patent Publication No. 62-156990 and Laid-open Patent Publication No. 62-244693). By the use of the aforementioned additives it was indeed possible to improve the sticking resistance, but this caused such other problems as poor gloss and low printing concentration.

SUMMARY OF THE INVENTION

Having been made in view of the aforementioned circumstances, it is the object of the present invention to provide a heat-sensitive recording material excelled in surface gloss and printing concentration as well as sticking resistance, resistance to water or solvent.

DISCLOSURE OF THE INVENTION

The aforementioned object of the present invention can be accomplished by providing a protective coating containing an aqueous resin dispersion and crosslinked microfine particles obtainable through emulsion polymerization of a vinyl monomer on the surface of a heat-sensitive color-developing layer on a supporting member. In other words, the present invention relates to a heat-sensitive recording material comprising a heat-sensitive color-developing layer formed on a supporting member and protective layer, and more specifically to a heat-sensitive recording material excelled in surface gloss and printing concentration, in which the aforementioned protective coating containing an aqueous resin dispersion (A) and crosslinked microfine particles substantially having no glass transition temperature and not more than 0.5 μm in mean particle size obtained by emulsion-polymerization of vinyl group-containing polymeric monomer containing not less than 15 weight % of polymeric multifunctional monomer is provided on the surface of the aforementioned heat-sensitive color-developing layer.

DETAILED DESCRIPTION OF THE INVENTION

As the supporting member according to the present invention paper, plastic films, synthetic papers or the like may possibly be used.

The heat-sensitive color-developing layer formed on the supporting member is obtainable by applying a liquid coating composition prepared by dispersing in a binder known leuco dye/s, developer/s and various additives and/or auxiliaries described below and the like, this followed by drying.

As the aforementioned leuco dyes, known leuco compound may be usable, for example, triphenylmethane-type, fluoran-type, phenothiazine-type, auramine-type, spiropyran-type and indolinophthlide-type. As leuco dyes may be cited such as 3,3-bis(p-dimethylaminophenyl)phthalide, 3,3-bis(p-dimethylaminophenyl)-6-dimethylaminophthalide [Crystal Violet lactone], 3,3-bis(p-dimethylaminophenyl)-5-diethylaminophthalide, 3,3-bis (p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-[N-(3'-trifluoromethylphenyl)amino]-6-diethylaminofluoran, 2-[3,6-bis(diethylamino)-9-(o-chloroanilino)xanthylactambenzoate, 3-diethylamino-6-methyl-7-(m-trichloromethylanilino)fluoran, 3-dimethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)fluoran, benzoilleucomethyleneblue, 6'-chloro-4'-methoxy-benzoindolinopyrylospiran, 5'-bromo-3'-methoxybenzoindolinopyrylospiran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'- nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzil-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(α-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-benzil-N-cyclohexylamino)-5,6-benzo-7-α-naphtylamino-4'-bromofluoran, 3-diethylamino-6-methyl-7-mesitydino-4',5'-benzofluoran.

As the aforementioned developers to be incorporated in the liquid coating composition are chemicals which act to develop the aforementioned leuco dyes through reaction therewith under heating may be used, for example, phenolic compounds, organic or inorganic substances or their esters and salts. For example, gallic acid, salicylic acid, 3-isopropylsalicylic acid, 3-cyclohexylsalicylic acid, 3,5-di-tertbutylsalicylic acid, 3,5-di-α-methylbenzylsalicylic acid, 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,8-dimethylphenol), 4,4'-isopropylidene-bis(2-tert-butylphenol), 4,4'-secbutylidenediphenol, 4,4'-cyclohexylidenebis(2-methylphenol), 4-tert-butylphenol, 4-phenylphenol, 4-hydroxydiphenoxide, α-naphtol, β-naphtol, 3,5-xylenol, thymol, methyl-4-hydroxybenzoate, 4-hydroxyacetophenone, novolak-type-phenolic resin, 2,2'-thiobis(4,6-dichlorophenol), catechol, resorcine, hydroquinone, pyrogallol and phloroglycinecarboxylic acid, 4-tert-octylcatechol, 2,2'-methylenebis(4-chlorophenol), 2,2'-methylenebis(4-methyl-6-tert-butylphenol), 2,2'-dihydroxydiphenyl, p-hydroxyethylbenzoate, p-hydroxypropylbenzoate, p-hydroxybutylbenzoate, p-hydroxybenzylbenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphtoic acid, 2-hydroxy-5-naphtoic acid, 2-hydroxy-6-zinc naphtoate, 4-hydroxydiphenylsulfone, 4-hydroxy-4'-chlorodiphenylsulfone, bis(4-hydroxyphenyl)sulfide, 2-hydroxy-p-toluic acid, 3,5-di-tert-butylzinc salicylate, 3,5-di-tert-butyltin salicylate, tartaric acid, oxalic acid, maleic acid, citric acid, succinic acid, stearic acid, 4-hydroxyphthalic acid, boric acid and thiourea derivatives may be usable.

As the binder mentioned above, for example, polyvinyl alcohol, starches, starches derivatives, cellulose derivatives [e.g. methoxycellulose, hydroxyethylcellulose, carboxymethylcellulose, methylcellulose, ethylcellulose, etc.), polyacrylic sodium, polyvinylpyrrolidone, acrylamide/acrylate copolymer, acrylamide/acrylate/methacrylic acid terpolymer, styrene/anhydrous maleic acid copolymer alkali salt, isobutylene/anhydrous maleic acid copolymer alkali salt, polyacrylamide, alginic sodium, gelatin and casein may be usable.

The aforementioned liquid coating composition containing the leuco dyes, developers and binders may further contain, as necessary, usual additives such as sensitizers, fillers, surfactants, thermofusing substances and the like. As fillers may be cited inorganic microfine powders such as calcium carbonate, silica, zinc oxide, titanium oxide, aluminum hydroxide, zinc hydroxide, barium sulfate, clay, talc, surface-treated calcium and silica, and organic microfine powders such as urea-formaldehyde resin, styrene-methacrylic acid copolymer and polystyrene resin. As thermofusing substances may be cited, among others, higher fatty acids or their esters amides or their metallic salts, various waxes, mixtures of aromatic carboxylic acids and amines, benzoic acid phenyl esters, higher linear glycols, 3,4-epoxy-hexahydrophthalic dialkyl, higher ketons and other thermofusing organic compounds 50°~200° C. in melting point.

The protective coating formed on heat-sensitive color-developing layer is obtainable through application of a liquid coating composition containing aqueous resin dispersion (A) and crosslinked microfine particles (B) substantially having no glass transition temperature not more than 0.5 μm in mean particle size obtained through emulsion-polymerization of polymeric multifunctional monomers containing not less than 15 weight % of polymeric monomer. The individual components of the liquid coating will be described below.

Aqueous resin dispersion (A) is a binder component of the liquid coating composition and any one of the conventional binders may be used as such. For example, acrylic emulsion, styrene-acrylic emulsion, styrene-vinylacetate emulsion and SBS emulsion may well be usable. Also preferred are the so-called self-crosslinking type emulsion disclosed in Laid-open Patent Publication No.63-258193 or No.64-38405, being improved in sticking resistance. Further, preferred is one with its aqueous resin dispersion (A) being acryl type emulsion, which is suited for manufacturing a heat-sensitive recording paper excelled in surface gloss and printing concentration.

There is no particular limitation about the dose of the aqueous resin dispersion but normally it is in a range of 20~400 weight %. As aqueous resin dispersion (A) which acts as the binder component of the liquid coating composition it is preferred to use the aforementioned acryl type emulsion unmixed but it is possible to use it in combination with some of the binder components illustrated for the heat-sensitive color-developing layer on condition that it does not adversely influence the performance of the protective coating.

The crosslinked microfine particles (B) substantially having no glass transition temperature and not more than 0.5 μm in particle size obtained by emulsion-polymerization of polymeric monomer containing not less than 15 weight % of polymeric multifunctional monomer used in the present invention are for improvement of the protective coating in sticking resistance. By one substantially having no glass transition temperature is meant one showing no sharp endothermic peak when measurement is taken by the use of a differential scanning calorimeter.

Inorganic pigments, cellulose powder, microfine glass powder, colloidal silica, thermosetting resin such as urea formaldehyde resin, silicone type compounds et cetera were not suited for forming a protective coating of high transparency and good sticking resistance for such substances are themselves opaque, too large in particle size and/or lack in adhesion to the binder component. In contrast thereto, the crosslinked microfine particles (B) allow compatibility of sticking resistance with transparency of the protective coating when they are used together with the aqueous resin dispersion (A), this giving a heat-sensitive recording material excelled in both surface gloss and printing concentration.

As polymeric multifunctional monomer usable for synthesis of crosslinked microfine particles may be cited, among others, multifunctional (meth)acrylates having more than one polymeric unsaturated groups in the molecule such as multiesterification [e.g. di-, triesterification or more] products of (meth)acrylic acid with polyhydric alcohols such as ethyleneglycol, 1,3-butyleneglycol, diethyleneglycol, 1,6-hexanediol, neopentylglycol polyethyleneglycol propyleneglycol, polypropyleneglycol, neopropyleneglycol, trimethylolpropane, pentaerythritol and dipentaerythritol; (meth)acrylamides having more than one polymeric unsaturated groups in the molecule such as methylenebis(meth)acrylamide; multifunctional allyl compounds having more than one polymeric unsaturated groups in the molecule such as diallylphthalate, diallylmaleate and diallylfumalate; allyl(meth)acrylate and divinylbenzene, any one or more than one thereof in combination.

As another monomer usable for synthesis of crosslinked microfine particles may be cited, styrene derivatives [e.g. styrene, vinyltoluene, α-methylstyrene, chloromethylstyrene, etc.]; (meth)acrylamide derivatives [e.g. (meth)acrylamide, N-monomethyl(meth)acrylamide, N-monoethyl(meth)acrylamide, N,N-dimethyl(meth)acrylamide, etc.]; (meth)acrylate such as esterification products of $C_1 \sim C_{18}$ alcohols with (meth)acrylic acids such as methyl(meth)acrylate, ethyl(meth)acrylate, butyl(meth)acrylate; hydroxy group-containing (meth)acrylate such as 2-hydroxyethyl(meth)acrylate, 2-hydroxypropyl(meth)acrylate and monoesters of (meth)acrylic acid and polypropyleneglycol; vinylacetate, (meth)acrylonitrile; polymerizable basic monomers, such as dimethylaminoethyl(meth)acrylate, dimethyl-aminoethyl(meth)acrylamide, dimethylaminopropyl(meth)acrylamide, vinylpyridine, vinylimidazole and vinylpyrrolidone; closslinkable (meth)acrylamide, such as N-methylol(meth)acrylamide and N-butoxymethyl(meth)acrylamide; monomers are having hydrolyzable silicon group directly bound to the silicon atom, such as vinyltrimethoxysilane, vinyltriethoxysilane, γ-(meth)acryloyloxypropyltrimethoxysilane, vinyltris(2-methoxyethoxy)silane and allyltriethoxysilane: epoxy group-containing monomers, such as glycidylacrylate, allylglycidyl ether; oxazoline group-containing monomers, such as 2-isopropenyl-2-oxazoline and 2-vinyloxazoline; aziridine group-containing monomers, such as 2-aziridinylethyl(meth)acrylate and (meth)acryloylaziridine; vinylfluoride, vinylidenefluoride, vinylchloride and vinylidenechloride. These may be used either singly or in the form of a mixture of two or more.

In order to obtain crosslinked microfine particles (B) substantially having no glass transition temperature, however, the glass transition temperature of the polymer made of polymeric monomers other than polymeric multifunctional monomers is preferred to be not less than 70° C., and more preferably not less than 90° C. When it is less than 70° C., it may be possible in some cases that the crosslinked microfine particles having a sufficient heat resistance so as not to have substantially any glass transition temperature are obtainable even when polymeric multifunctional monomers is added.

The crosslinked microfine particles (B) used in the present invention are obtainable through emulsion-polymerization by a known method of polymeric monomers containing not less than 15 weight % of the aforementioned polymeric multifunctional monomer in an aqueous medium, that is, by any of the known methods of emulsion-polymerization. As such methods may be cited, among others, methods of polymerizing a mixture of known polymerization initiators, emulsifiers, water and polymeric monomers, the so-called monomer dropping method, pre-emulsion method, seed polymerization method and multi-step polymerization method.

As the known polymerization initiators may be cited, for example, persulfates such as potassium persulfate, ammonium persulfate and sodium persulfate; water-soluble azo-type compounds such as 2,2'-azobis(2-aminodipropane)dichlorate and 4,4'-azobis(4-cyanopentanoic acid); and hydrogen peroxide.

As emulsifiers used for emulsion-polymerization are known, among others, anionic emulsifiers such as sodium dodecylbenzene sulfonate and sodium dodecyl sulfate; nonionic emulsifiers such as polyethylene oxide having nonylphenyl groups and block copolymers of polypropylene and polyethyleneoxide; and cationic emulsifiers such as trimethylstearyl ammonium chloride.

Polymerizing temperature is in a range of $0° \sim 100°$ C., preferably in a range of $50° \sim 80°$ C., and polymerization time is $1 \sim 10$ hours. Addition of some hydrophilic solvent in the course of emulsion-polymerization is feasible on condition that it does not adversely influence the physical properties of the crosslinked microfine particles (B).

The refractive index of the crosslinked microfine particles (B) used in the present invention is adjustable through modification of the composition of the polymeric monomer but, in order to keep the transparency of the protective coating high to thereby obtain a heat-sensitive recording material excelled in surface gloss and printing concentration, it is preferable to keep the difference between their refractive index and that of the polymer of the aqueous resin dispersion (A) not more than 0.05, more preferably not more than 0.02. The transparency of the protective coating increases, the printed image visible through the protective coating becomes more clear, the printing concentration increases and the surface gloss increases, too, as the difference in refractive index decreases.

It is already emphasized that, to obtain a heat-sensitive recording material excelled in printing concentration and surface gloss, it is important to pay attention to refractive index and try to improve the transparency of the protective coating, but it is no less important to try to prevent diffused reflection of light. Hence, it is important to control the mean particle size of the crosslinked microfine particles (B) to be not more than 0.5 μm, preferably not more than 0.2 μm. If the mean particle size should exceed 0.5 μm, the diffused reflection of light is bound to increase. Even if the mean particle size is less than 0.5 μm, crosslinked microfine particles including coarse particles larger than 1 μm, in particle size interfere with preparation of heat-sensitive recording materials excelled in both surface gloss and printing concentration. Generally, the particle size of polymers obtainable by emulsion-polymerization is $0.05 \sim 0.5$ μm and the particle size distribution is narrow. Conversely, the particle size of polymers obtained by suspension polymerization is 1 μm, or more, the particle size distribution being relatively wide. Hence, the crosslinked microfine particles (B) used in the present invention is required to be what are prepared by emulsion-polymerization. Although the crosslinked microfine particles (B)

are to be used instead of conventional fillers, it is also possible to use them in combination with some of the fillers enumerated above as good for the heat-sensitive color-developing layer on condition that it does not adversely influence the performance of the protective coating.

The protective coating of the present invention requires the aforementioned aqueous resin dispersion (A) and crosslinked microfine particles (B) substantially having no glass transition temperature obtainable by emulsion-polymerization of polymeric monomers containing not less than 15 weight % of polymeric multifunctional monomers as essential components but, beside these, additives such as known thermofusing substances, pH adjusters, viscosity adjusters and crosslinking agents useful in the manufacture of a heat-sensitive recording material on condition that any thereof does not adversely influence the performance of the protective coating. These additives can be added by some of the known methods and can be mixed with and dispersed in a coating composition by the use of, for example, a stirrer, mixer or dispersing device.

The heat-sensitive recording material of the present invention is obtained by first forming a heat-sensitive color-developing layer on a supporting member such as paper, plastic film or synthetic paper by a known method, then applying thereon the aforementioned coating composition, drying and, if necessary, forming thereafter a protective coating by calendering. There is no particular limitation about the thickness of the protective coating but it may preferably be in a range of 1~10 μm and more preferably in a range of 2~5 μm.

Examples of the present invention are given below. These are, however, given for the purpose of illustration and are by no means for limiting the scope of the invention. Part and percentage (%) given in the description below mean weight part and weight % respectively.

REFERENCE EXAMPLE 1

Example of Manufacture of Crosslinked Microfine Particles 170 parts of ion exchanged water and 0.2 parts of 25% aqueous solution of Hitenol N-08 (anionic emulsifier of Daiichi Kogyo Seiyaku Co., Ltd.) were charged into a flask equipped with a dropping funnel, stirrer, nitrogen inlet pipe, thermometer and condenser and the mixture was heated to 70° C. with nitrogen gas being flowed slowly. Then 10 parts of 5% aqueous solution of ammonium persulfate was added and tereafter a pre-emulsion of polymeric monomer prepared in advance by pre-emulsifying 140 parts of methylmethacrylate and 60 parts of divinylbenzene in 21 parts of 25% aqueous solution of Hitenol N-08 and 83 parts of ion-exchange water was dropped over 2 hours from the dropping funnel. After completion of dropping the temperature was raised to 85° C., stirring was continued for 1 hour and then the temperature was lowered to conclude polymerization. The crosslinked microfine particles (1) thus obtained as the reaction product had a solid concentration of 42.3%, were 1.523 in refractive index at 25° C., 0.21 μm in mean particle size as determined by the light scattering measurement, and substantially had no glass transition temperature when tested by the differential scanning calorimetry (DSC).

REFERENCE EXAMPLE 2

Example of Manufacture of Crosslinked Microfine Particles 170 parts of ion exchanged water and 0.1 part of SN-4 (anionic emulsifier of Sumitomo Naugatuck Co., Ltd., solid content 45±1%) were charged into the same flask as used in Reference Example 1 and the mixture was heated to 70° C. with nitrogen gas being flowed slowly. Then 5 parts of 5% aqueous solution of 2,2'-azobis(2-amidinopropane)dihydrochloride and thereafter a pre-emulsion of polymeric monomer prepared in advance by pre-emulsifying 112 parts of methylmethacrylate, 30 parts of styrene, 30 parts of trimethylolpropanetrimethacrylate, 8 parts of vinyltrimethoxysilane and 20 parts of ethylacrylate in 15 parts of anionic emulsifier SN-4 and 83 parts of ion exchanged water was dropped over 3 hours from the dropping funnel. After completion of dropping the temperature was raised to 85° C., stirring was continued for 1 hour and then the temperature was lowered to conclude polymerization. The crosslinked microfine particles (2) thus obtained as reaction product had a solid content of 43.9%, were 1.504 in refractive index at 25° C., 0.27 μm in mean particle size as determined by the light scattering measurement and very slight endothermic peak was noted at 130° C. when tested by the differential scanning calorimetry (DSC).

REFERENCE EXAMPLES 3~5

Examples of Manufacture of Crosslinked Microfine Particles

In the same flask as used in Reference Example 1 crosslinked microfine particles (3)~(5) were obtained by the same procedure as in Reference Example 1 except that the composition and quantity of the polymeric monomer were as indicated in Table 1. The result of the measurement of the physical properties is also shown in Table 1.

TABLE 1

| Examples No. | Crosslinked microfine dispersion | Monomer components | (part) | Solid content (%) | Refractive index (25° C.)[1] | Mean particle size (μm)[2] | Tg (°C.)[3] |
|---|---|---|---|---|---|---|---|
| Reference 1 | (1) | Methylmethacrylate | 140 | 42.3 | 1.523 | 0.21 | Unnoticeable |
| | | Divinylbenzene | 60 | | | | |
| Reference 2 | (2) | Methylmethacrylate | 112 | 43.9 | 1.504 | 0.27 | Unnoticeable (Slight endo thermic peak at 130° C., though) |
| | | Styrene | 30 | | | | |
| | | Trimethylolpropane-trimethacrylate | 30 | | | | |
| | | Vinyltrimethoxysilane | 8 | | | | |
| | | Ethylacrylate | 20 | | | | |
| Reference 3 | (3) | Styrene | 100 | 42.0 | 1.540 | 0.17 | Unnoticeable |
| | | Methyl methacrylate | 20 | | | | |
| | | Ethyleneglycoldiacrylate | 80 | | | | |
| Reference 4 | (4) | Styrene | 140 | 42.3 | 1.600 | 0.29 | Unnoticeable |
| | | Divinylbenzene | 60 | | | | |
| Reference 5 | (5) | Methylmethacrylate | 70 | 22.3 | 1.488 | 0.10 | Unnoticeable |

TABLE 1-continued

| Examples No. | Crosslinked microfine dispersion | Monomer components | (part) | Solid content (%) | Refractive index (25° C.)[1] | Mean particle size (μm)[2] | Tg (°C.)[3] |
|---|---|---|---|---|---|---|---|
| | | Trimethylolpropane-trimethacrylate | 30 | | | | |
| Comp. 1 | (1') | Methylmethacrylate | 190 | 42.1 | 1.496 | 0.30 | 115° C. |
| | | Divinylbenzene | 10 | | | | |
| Comp. 2 | (2') | Methylmethacrylate | 49 | 100.0 | 1.523 | 3 | Unnoticeable |
| | | Divinylbenzene | 21 | | | | |

[1]Polymeric monomer was cast-polymerized, and measurement was taken by the use of Appe Refractometer of Atago, Ltd.
[2]Measurement was taken by the use of Dynamic Diffused Light Photometer DLS-700 of Ohtsuka Electronic, Ltd. For the crosslinked microfine particles (2') with which measurement was unfeasible with DLS-700, however, Coaltar Multisizer of Nikkaki, Ltd. was used instead.
[3]Measurement was taken by the use of heat-compensation type differential scanning calorimeter of Shimadzu Corp. Heating rate: 10° C./min. Temperature range: Normal temperature ~ 250° C.

COMPARATIVE EXAMPLE 1

Example of Manufacture of Crosslinked Microfine Particles for Comparison

Crosslinked microfine particles for comparison (1') 42.1% in solid content were obtained by the same procedure as in Reference Example except that the composition of the polymeric monomer used as material was 190 parts of methylmethacrylate and 10 parts of divinylbenzene. The physical properties thereof were 1.496 in refractive index at 25° C., 0.30 μm in mean particle size as measured by the light scattering measuring method and approximately 115° C. in glass transition temperature.

COMPARATIVE EXAMPLE 2

Example of Manufacture of Crosslinked Microfine Particles for Comparison 250 parts of ionexchanged water and 7 parts of 5% aqueous solution of PVA-205 (Kuraray Co., Ltd.) were charged into a flask equipped with a stirrer, nitrogen inlet pipe, thermometer and reflux condenser, 49 parts of methylmethacrylate and 21 parts of divinylbenzene were then added and the mixture was stirred and dispersed by a homogenizer. After introduction of nitrogen gas for 20 minutes the reaction mixture was heated to 60° C. to initiate polymerization. The temperature was lowered 4 hours later to conclude polymerization and crosslinked microfine particles for comparison (2') were obtained by subsequent filtration and drying. The physical properties thereof were 1.523 in refractive index at 25° C. and 3 μm in mean particle size as measured by Coulter Counter® (Coulter Counter Limited.), and substantially no glass transition temperature was noticeable when tested by the differential scanning calorimetry.

REFERENCE EXAMPLE 6

Manufacture of Coating

Coating compositions [I]~[V] and coating compositions for comparison [I']~[VI'] were prepared with the crosslinked microfine particles (1)~(2) obtained in Reference Examples 1~5 and the crosslinked microfine particles for comparison (1', 2') obtained in Comparative Examples 1~2 as material by the recipes shown in Table 2.

TABLE 2

| Coating comp. No. | Aqueous resin dispersion | (part) | Crosslinked particles | (part) | Additive | |
|---|---|---|---|---|---|---|
| [I] | Acryset 202E | 100 | (1) | 200 | Glyoxal | 10 |
| [II] | Acryset 202E | 100 | (4) | 200 | Glyoxal | 10 |
| | | | | | PVA-CST | 1 |
| [III] | Acryset 250E | 100 | (3) | 50 | Sumitex Resin M-3 | 10 |
| [IV] | Acryset 250E | 100 | (2) | 100 | Glyoxal | 10 |
| | | | | | Zinc stearate | 2 |
| [V] | Acryset SC-313 | 100 | (5) | 100 | Glyoxal | 10 |
| | | | | | PVA-CST | 1 |
| Comp. [I'] | Acryset 202E | 100 | Comp. [1'] | 200 | Glyoxal | 10 |
| Comp. [II'] | Acryset 202E | 100 | Comp. [2'] | 100 (pdr.) | Glyoxal | 10 |
| Comp. [III'] | Acryset 202E | 100 | — | | Kaolin clay | 400 |
| | | | | | Glyoxal | 10 |
| Comp. [IV'] | Acryset 202E | 100 | — | | Snowtex C | 400 |
| | | | | | Glyoxal | 10 |
| Comp. [V'] | Acryset 202E | 100 | — | | Eposter S-12 | 100 |
| | | | | | Glyoxal | 10 |
| Comp. [VI'] | PVA-117 (10% aq. solution) | 100 | — | | Glyoxal | 10 |
| | | | | | Urea-formaldehyde resin (0.3 μm) | 10 |

| Trade name | Maker | Chief ingred. | Solid cont. | Refractive index |
|---|---|---|---|---|
| Acryset 202E | N.S. | Acryl emulsion | 49% | 1.480 |
| Acryset 250E | " | Styrene acryl emul. | 49% | 1.531 |
| Acryset SC-313 | " | Self-crosslinking type acryl emulsion | 49% | 1.485 |
| Eposter S-12 | " | Melamine microfine pdr. | (Mean Particle size 1.2 μm) | |
| Snowtex C | N.K. | Colloidal silica | (Mean Particle size 0.01~0.02 μm) | |
| PVA-CST | K. | Polyvinyl alcohol | | |
| PVA-117 | " | " | | |
| Sumitex | S.C. | Water-soluble | | |

TABLE 2-continued

| | |
|---|---|
| Resin M-3 | methylolized melamine |

Maker:
N.S. = Nippon Shokubai Co., Ltd.
N.K. = Nissan Chemical Industries, Ltd.
K. = Kuraray Co., Ltd.
S.C. = Sumitomo Chemical Co., Ltd.

EXAMPLE 1

| | |
|---|---|
| [Liquid composition A] | |
| 3-(N-cyclohexyl-N-methylamino)-6-methyl-7-anilinofluoran | 30 parts |
| 10% aqueous solution of polyvinyl alcohol | 30 parts |
| Water | 40 parts |
| [Liquid composition B] | |
| Bisphenol A | 30 parts |
| 10% aqueous solution of polyvinyl alcohol | 25 parts |
| Water | 45 parts |
| [Liquid composition C] | |
| Amide stearate | 25 parts |
| Calcium carbonate | 30 parts |
| 10% aqueous solution of polyvinyl alcohol | 20 parts |
| Water | 25 parts |

The above compositions were dispersed by sand mill until the particle size was reduced to 1 μm and the liquid compositions A, B and C were obtained. Then 20 parts of the liquid composition A, 70 parts of the liquid composition B and 10 parts of the liquid composition C were mixed to prepare a coating for heat-sensitive color-developing layer and the coating so prepared was applied to one side of a quality paper 50 g/m$^2$ in basis weight.

Then each of the coating compositions [I]~[V] prepared in Reference Example 6 and coating compositions for comparison [I']~[VI'] was diluted with water to a solid concentration of 15%, applied on the heat-sensitive color-developing layer to a dry specific weight of 3 g/m$^2$, and a protective coating was formed by subsequent drying. The surface of the protective coating was then finished by super calender to a smoothness of not less than 3,000 seconds for preparation of heat-sensitive recording material 1'~6'. Heat-sensitive recording material for comparison 7' was prepared by super-calendering the surface of the heat-sensitive color-developing layer without forming the protective coating.

The sticking resistance, the gloss of the surface printed full in black (incident angle 75°) and the blackness of these samples were measured by the use of the following instruments.

The result was as shown in Table 3.

*Sticking resistance: After full-printing in black by the use of the copying function of FACOM FAX evaluation was made against the following 5-step scale.
5: No sticking sound
4: Sticking sound low
3: Sticking sound medium
2: Sticking sound high, skipping of print noted partially
1: Sticking sound high, skipping of print noted all over
*Gloss of printed surface: Gloss of the surface printed full in black was measured by the use of Gloss-meter-VG-ID (Nippon Denshoku Kogyo, Ltd.) at an incident angle of 75°.
*Blackness: Measurement was taken by the use of Macbeth densimeter RD914 (Kollmorgen Co.).

TABLE 3

| Heatsensitive recording material No. | Coating composition No. | Sticking resistance | Gloss of printed surface | Blackness |
|---|---|---|---|---|
| 1 | [I] | 5 | 79 | 1.60 |
| 2 | [II] | 5 | 70 | 1.59 |
| 3 | [III] | 4 | 83 | 1.63 |
| 4 | [IV] | 4 | 80 | 1.61 |
| 5 | [V] | 5 | 88 | 1.67 |
| For comp'n | For comp'n | | | |
| 1' | [I'] | 2 | 78[1)] | 1.50 |
| 2' | [II'] | 4 | 42 | 1.13 |
| 3' | [III'] | 4 | 30 | 1.25 |
| 4' | [IV'] | 4 | 38 | 1.23 |
| 5' | [V'] | 5 | 28 | 1.03 |
| 6' | [VI'] | 4 | 43 | 1.19 |
| 7' | — | 2 | 9[1)] | 1.40 |

[1)]Measurement was taken of the gloss value before printing since measurement after printing was infeasible.

EFFECT OF THE INVENTION

The heat-sensitive recording material of the present invention features the improvement of the transparency of the protective coating attainable by reducing the particle size of the crosslinked microfine particles to 0.5 μm or less and also reducing the difference in refractive index between the polymer of the aqueous resin dispersion and the crosslinked microfine particles, hence with it images improved in surface gloss and high in printing concentration compared with the conventional heat-sensitive recording materials are attainable.

As shown in the examples, the images so obtained are excellent compared with not only those with conventional protective coating but also those without protective coating for preventing the superficial diffused reflection coating, being higher in printing concentration and improved in contour sharpness. Needless to say, the heat-sensitive recording material is improved in resistance to solvents, water, plasticizers, pressure et cetera definitely better than with any of the conventional protective coatings.

Particularly excelled in surface gloss and printing concentration as it is, the heat-sensitive recording material of the present invention is very suited for such variety of uses as printing papers for printers of computers and word processors, facsimiles and various measuring instruments, prepaid cards, tickets, labels and the like that can be printed thermally.

We claim:

1. A heat-sensitive recording material with a heat-sensitive color-developing layer formed on a supporting member characterized in that there is provided on surface of said heat-sensitive color-developing layer a protective coating containing crosslinked microfine particles (B) obtained by emulsion-polymerizing vinyl-containing polymeric monomers containing not less than 15 weight % of polymeric multifunctional monomers together with aqueous resin dispersion (A) selected from the group consisting of acrylic emulsion, styrene-acrylic emulsion, styrene-vinyl acetate emulsion and styrene-butadiene-styrene emulsion.

2. A heat-sensitive recording material according to claim 1, wherein the difference in refractive index between said crosslinked microfine particles and the solid content of said aqueous resin dispersion (A) is not more than 0.05.

3. A heat-sensitive recording material according to claim 2, wherein said polymeric multifunctional monomers are multifunctional (meth)acrylates which are products of (meth)acrylic acid with polyhydric alcohols having more than one vinyl group in the molecule.

4. A heat-sensitive recording material according to claim 2, wherein said polymeric multifunctional monomers are aromatic compounds having more than one vinyl group in the molecule.

5. A heat-sensitive recording material according to claim 2, said vinyl group-containing polymeric monomers are at least one of (meth)acrylates, styrene, vinyl toluene, αmethylstyrene, chloromethylstyrene, and vinyltrialkoxysilane.

* * * * *